United States Patent [19]

Boddy

[11] 4,095,302

[45] Jun. 20, 1978

[54] MANUFACTURE OF SHOES

[75] Inventor: Harold Albert Boddy, Bristol, England

[73] Assignee: C. & J. Clark Ltd., Somerset, England

[21] Appl. No.: 724,745

[22] Filed: Sep. 17, 1976

[30] Foreign Application Priority Data

Sep. 18, 1975 United Kingdom ..... 38444/75

[51] Int. Cl.[2] ..... A43D 21/12

[52] U.S. Cl. ..... 12/8.1; 12/145

[58] Field of Search ..... 12/8.1, 8.2, 10.1, 10.5, 12/7, 12, 145

[56] References Cited

U.S. PATENT DOCUMENTS

| | | | |
|---|---|---|---|
| 2,655,672 | 10/1953 | Courchene | 12/8.1 |
| 3,097,379 | 7/1963 | Hawkins | 12/10.1 |
| 3,678,522 | 7/1972 | Bumbatek et al. | 12/8.1 |
| 3,685,072 | 8/1972 | Schindler et al. | 12/12 |

*Primary Examiner*—Patrick D. Lawson

*Attorney, Agent, or Firm*—Wenderoth, Lind & Ponack

[57] ABSTRACT

A method and apparatus for lasting the waist region of a shoe in which two resilient bands supported only by their opposite edges are each advanced bodily towards a respective side of a last on which an upper is supported. The moving bands operate progressively to conform the upper to the last in the direction both of the top line and feather line and when this has been achieved the bodily movement of the bands is terminated, one edge of each band is held stationary and the other edge is moved over and towards the bottom of the last so as to wrap the adjacent part of the band round the edge of the last and turn the lasting margin of the upper over and onto an insole. The part of the band which moves towards the last bottom is followed by presser feet which are operated to press this part of the band against the last bottom. The last used is preferably a back part mould which comprises the back part and waist region of a conventional last but omits the forepart of such last.

18 Claims, 9 Drawing Figures

MANUFACTURE OF SHOES

This invention relates to the manufacture of shoes and in particular to an improved method and apparatus for use in shoe lasting.

BACKGROUND OF THE INVENTION

The word "shoe" is used herein in a broad sense, whenever the context so permits, to include all forms of outer foot wear. The word "lasting" is used herein in a broad sense to refer to the procedure of adhesively securing a shoe upper to an insole by means of a turned over margin of the upper which is stuck to the insole, for example by the use of a heat activatable adhesive.

It is conventional in the manufacture of shoes to carry out the lasting operations in three stages of which the first is either a seat lasting or a toe lasting operation and the final stage is a waist lasting operation.

We have found that advantages are obtained by departing from this sequence and in accordance with this invention in its broadest aspect the improved method of manufacturing a shoe includes the steps of arranging a closed upper so as to extend under tension around the back part of a back part mould, positioning an insole on the mould, performing a waist lasting operation in which both sides of the upper are lasted simultaneously, and then, while the upper is still arranged on the mould, performing a seat lasting operation.

Subsequently the shoe will be removed from the mould and positioned on a suitable last in another machine in which a fore part lasting operation is performed.

In this specification the expression "waist lasting" is to be understood as referring to a region of a shoe which not only includes the actual waist area but which may also extend from the seat area up to and including at least part of the point area.

The term "back part mould" means a mould which includes the back part and waist region of a normal last but omits the fore part of such last.

In another aspect this invention comprises a method of manufacturing a shoe in which a closed upper, which is supported under tension so as to extend round the back part of a last arranged bottom uppermost with an insole thereon, is waist lasted by means of two resilient bands arranged one on each side of the waist region of the last, each band being supported only at its upper and lower edges and so as to extend heightwise of the last, the method including the steps of advancing each band bodily towards the last so as to engage firstly the upper and bring it into contact with the widest part of the last and then progressively to conform the upper to the last both in the direction of the top line and the feather line of the shoe and lengthwise of the last, terminating the bodily movement of each band, and then while the lower edge of each band is held stationary moving the upper edge over and downwardly towards the last bottom so as to wrap the adjacent part of the band round the edge of the last and towards the last bottom whereby to turn the lasting margin of the upper over onto the insole.

This invention also includes apparatus for lasting the waist region of a shoe comprising a post supporting a last, two lasting assemblies mounted for movement widthwise of the last and adapted for engaging respective sides of the waist region of an upper when arranged on the last, each assembly including a single resilient band extending heightwise of the last and supported only at its upper and lower edges, means for moving the assembly towards the last so as to cause the band progressively to conform such upper to the last both in the direction of the top line and feather line of the shoe to be lasted and lengthwise of the last, means for preventing further movement of the assembly towards the last, and means for moving an edge of the band relative to the assembly both widthwise and heightwise of the last so that the part of the band adjacent the feather line is rolled over onto the last bottom whereby to turn over the lasting margin of such upper and press it onto an insole supported on the last.

Each assembly may include a plurality of presser feet arranged in a row extending lengthwise of the last and means for moving the presser feet relative to the assembly both widthwise and heightwise of the last to press the resilient band against the last bottom.

In carrying out the invention it has been found that while a greater or lesser number of presser feet may be used four presser feet will normally suffice for use in lasting a wide range of shoe sizes.

Preferably each presser foot is so mounted that it can take up the orientation of that part of the last bottom against which it is pressed.

Conveniently the presser feet are each pivotally mounted in pairs on a support member which in turn is pivotally mounted on one end of a pivoted lever the other end of which is connected with an actuator mounted on the assembly. Operation of the actuator causes the presser feet to be moved outwardly from the assembly and towards the last bottom so that the band is pressed thereagainst. To distribute the pressure exerted by the presser feet a plate of flexible material may be arranged beneath the presser feet and this plate may be spring mounted so that it is not normally in contact with these feet.

The assembly may be provided with a stop which conveniently engages the last through the band and acts to stop the further movement of the assembly towards the last.

In the use of the method of this invention the upper and an insole are heated prior to the lasting operation so as to activate adhesive on the insole or lasting margin of the upper and also to soften the upper and any stiffeners which may be incorporated therein. Alternatively adhesive could be applied to the insole or lasting margin of the upper when these are positioned on the last, prior to the lasting operation.

The improved apparatus of this invention is preferably constructed in such a way that after a waist lasting operation has been completed a post on which the last is mounted may be swung so as to carry the last into a conventional heel seat lasting and back part moulding machine, wherein seat lasting can be effected while the upper and insole are still warm.

In carrying out the invention it is convenient to use a back part mould instead of a normal last.

BRIEF DESCRIPTION OF THE DRAWINGS

In order that the invention may be more readily understood it will now be described with reference to the accompanying drawings in which:

Referring now to the drawings, and to FIG. 1 in particular, there can be seen a back part mould 1 supported on a last post 1'. The mould 1 is disposed centrally of the waist lasting machine instrumentalities, including a toe gripper 2 and side grippers 4. The grippers 4 are individually supported on arms pivotally attached to the machine in the vicinity of the point of pivotal attachment of the last post 1'. which point is at the foot of the post. Disposed on either side of the mould 1 so as to be capable of operating on a shoe on the mould from joint to seat is a lasting band assembly 3, supported on arms 35. These arms are also pivotally attached to the machine. Behind the left hand (in FIG. 1) lasting band assembly is an insole steady 52 and behind and above the mould 1 is shown a conventional seat laster 53. FIG. 2 shows the right hand lasting band assembly in more detail, though the left hand assembly is shown only in outline.

In order to carry out a waist lasting operation, a closed shoe upper U is first located on the mould 1. The upper is fitted over the heel end of the mould and its top line is located against a spring loaded pin 5 mounted in the mould. The toe end of the upper U is formed with two small notches which the machine operator locates against two pins 6 in a lower jaw of the toe gripper 2.

Figure 1:
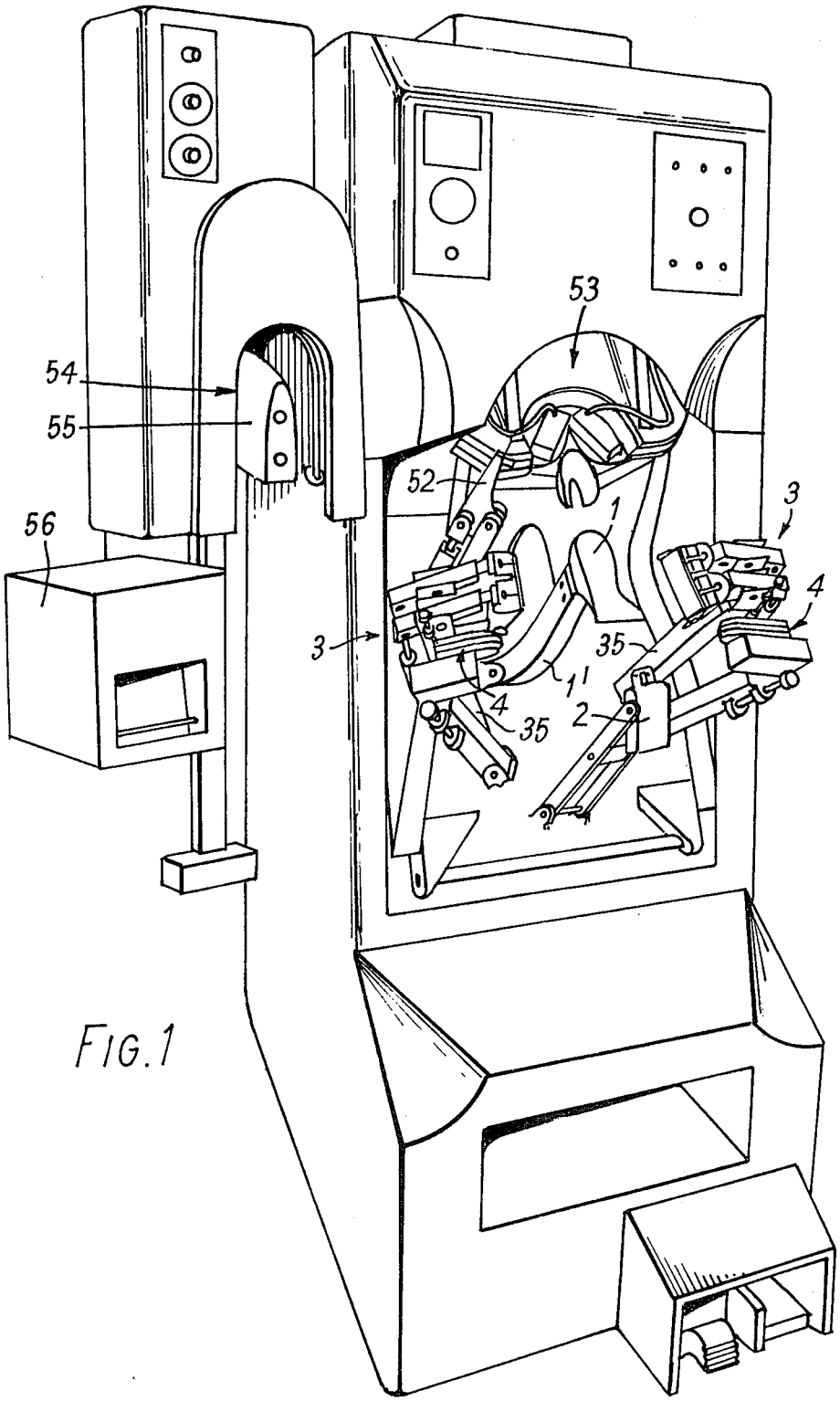
FIG. 1 is a diagrammatic perspective view of a waist lasting machine according to the invention combined with a known kind of seat lasting machine.
Figure 2:
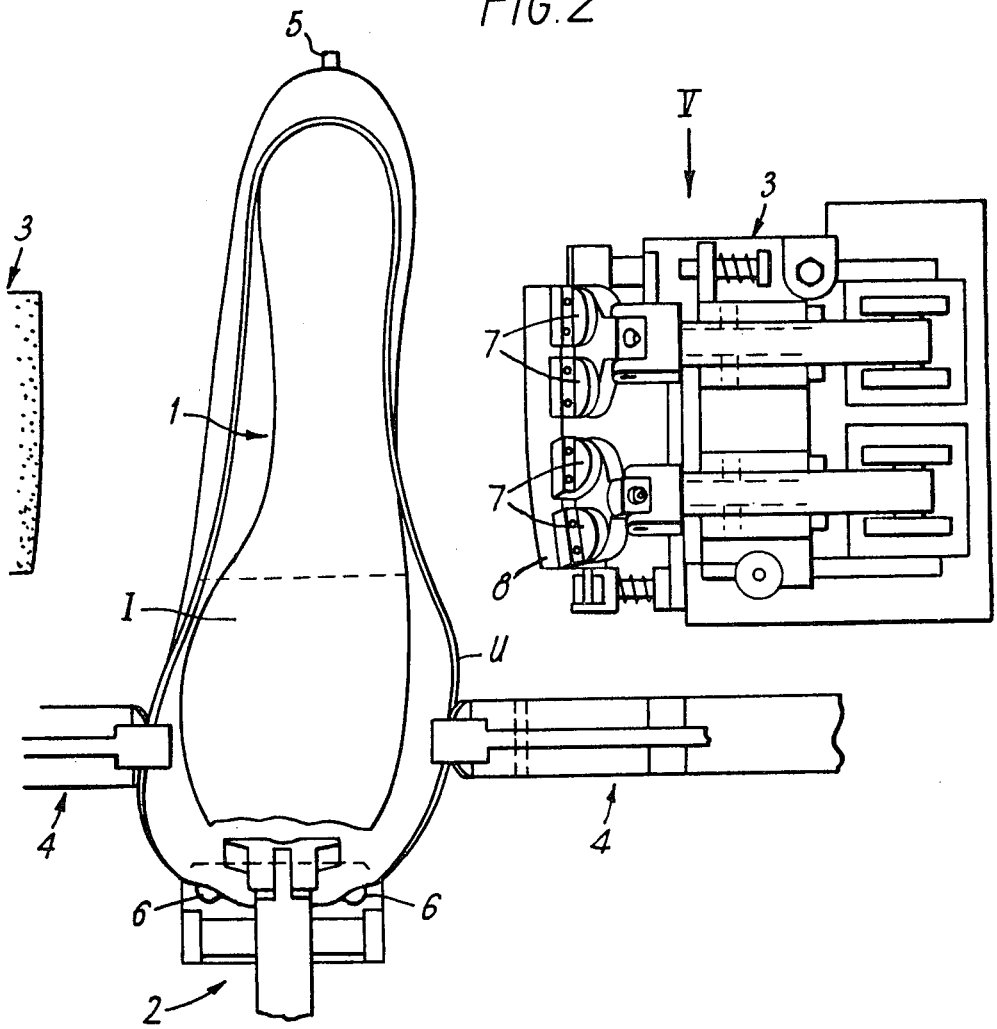
FIG. 2 is a diagrammatic plan view of part of the waist lasting machine.

When the toe gripper grips the upper, as shown in FIG. 2, it is moved away from the mould so as to tension the upper U about the heel end of the mould. At the same time the toe gripper 2 is actuated; the side grippers 4 automatically come in to their operating position, and then grip the sides of the upper and lift it to its correct position for lasting. The operator then fits an insole I to the bottom of the mould and actuates the insole steady 52, only shown in FIG. 1, to hold the insole I in position. Subsequently the machine completes its cycle of operation automatically; the separate operations being controlled by suitable time delays.

After the side grippers 4 have lifted the upper U to the correct position the band assemblies 3, which are carried on long pneumatically actuable arms 35 pivoted to the machine, move in towards the mould 1 and the bands 8 engage the upper in the waist region and initially press it against the mould at the position of maximum lateral extension thereof.

Further inward movement of the band assemblies 3 causes the bands to conform the upper to the mould and to turn partly over the lasting margin. Once this has happened the side grippers 4 are no longer required, they release their grip and move away. Movement of the assemblies is then stopped and presser feet 7 are moved inwardly and downwardly towards the mould bottom so as to press the bands thereagainst; whereby the lasting margin is bonded to the insole in the waist region, a suitable adhesive having been previously applied either to the lasting margin of the upper or to the insole I or to both the lasting margin and the insole.

The construction of the band assemblies will now be described in detail.

Figure 3:
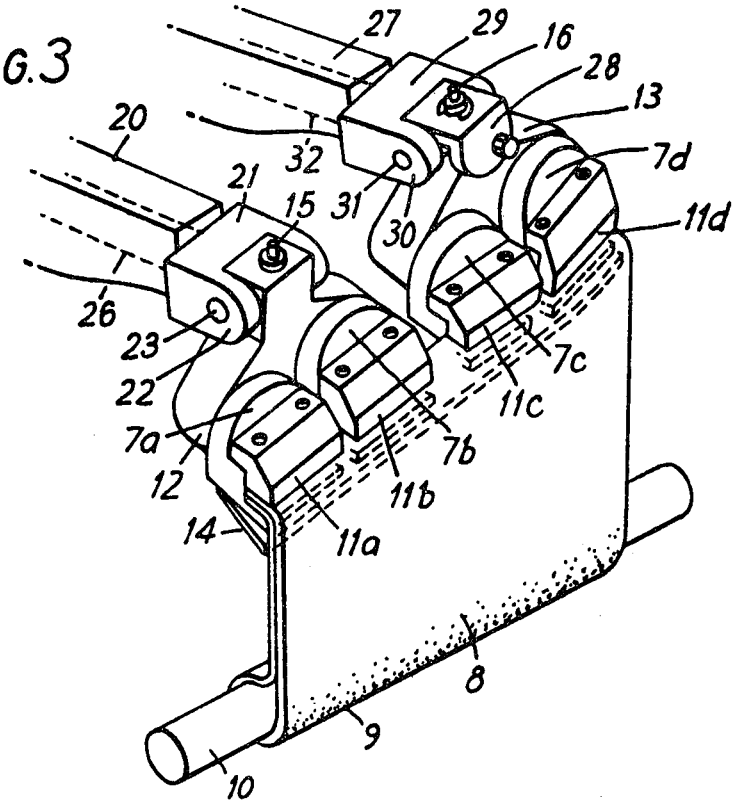
FIG. 3 is a perspective view of a partly removed right hand band unit of the waist lasting machine.
Figure 4:
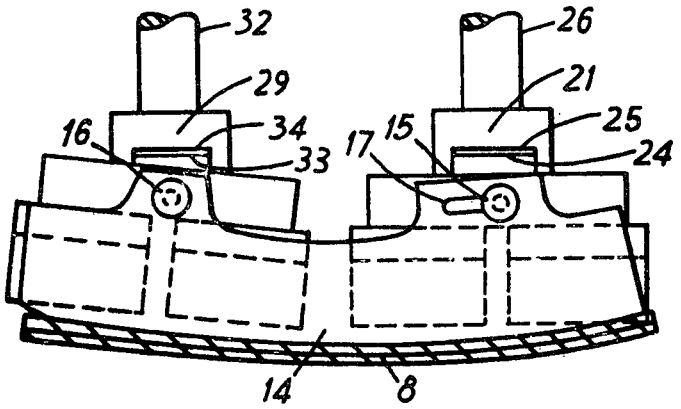
FIG. 4 is a part sectional underside view on the lines V—V in FIG. 5 of the top support of the band unit shown in FIG. 3.
Figure 5:
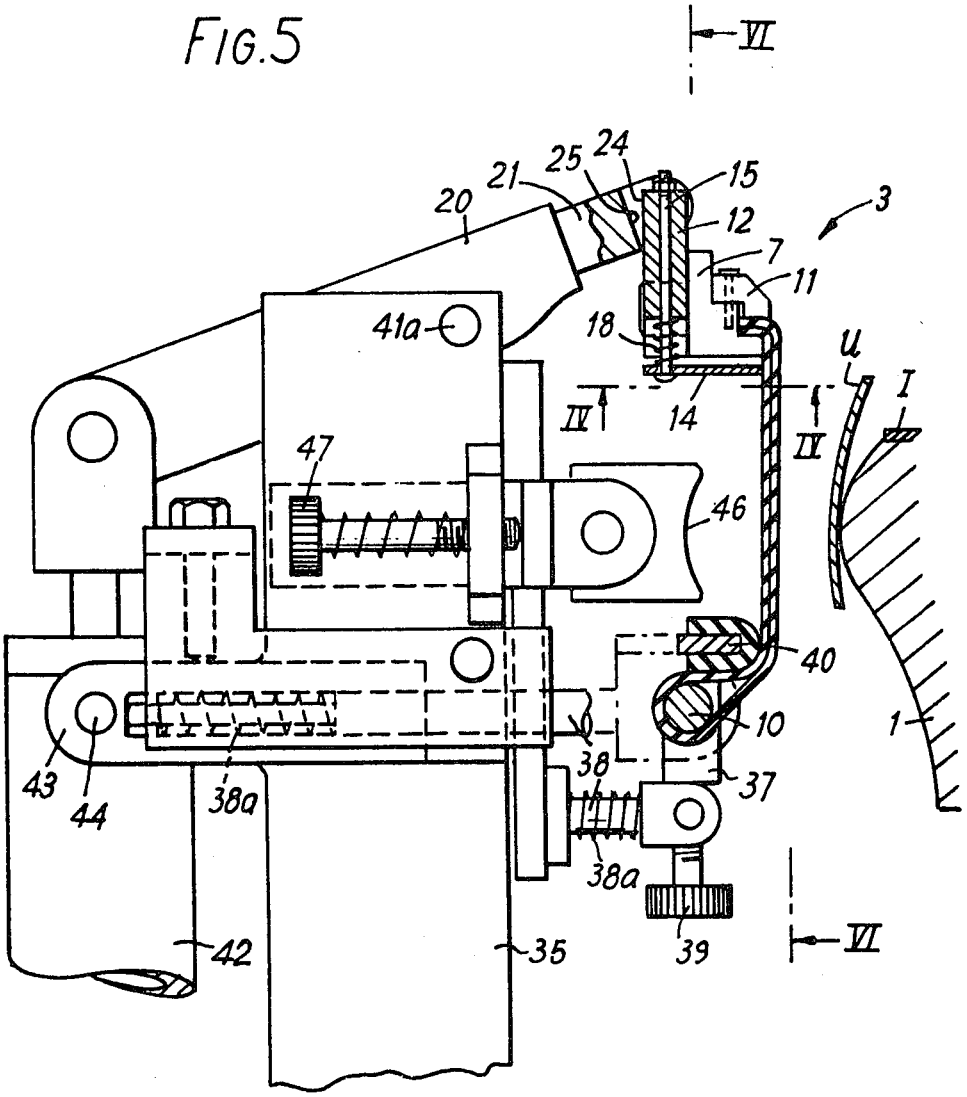
FIG. 5 is a part sectional end view, in the direction of arrow V in FIG. 2 of the right hand band assembly of the machine with the band in its position relative to an unlasted shoe prior to a waist lasting operation.

In order that the bands 8 should be readily replaceable, they and their direct supporting members are removable as units from the band assemblies. FIG. 3 shows one such unit partially disassembled from its assembly 3. Although herein described as a band, the band 8 is in reality a flat piece of rubber folded once. It is supported at the fold 9 by a pin 10; and the two ends are clamped to four presser feet 7*a*, 7*b*, 7*c* and 7*d* by blocks 11*a*, 11*b* 11*c* and 11*d*. These feet 7 are pivotally mounted in pairs to two band support members 12 and 13 with pivot axes approximately perpendicular to the plane of the band as shown in FIG. 5. Below the feet is a flexible back-up plate 14 which is best shown in FIG. 4. This plate, which may; for example; be of spring steel or nylon is loosely pinned to the support members by pins 15 and 16. Relative displacement of the support members 12 and 13 is accommodated by a slot 17 in the plate. The plate 14 is normally kept clear of the bottom of the feet 7 by springs 18 and 19 carried on the pins 15 and 16 respectively, see FIG. 6.

The support member 12 is supported pivotally about two mutually perpendicular axes at the end of a presser arm 20 by means of a pivot member 21 which carries the support member between two ears 22 on trunions 23. The pivot member 21 is itself pivotally mounted on the presser arm 20 by means of a shaft 26 journalled in an axial bore in the presser arm 20. Rotation of the support member 12 about the trunnions 23 is severely limited by interaction of the back face 24 of the support member 12 and the root face 25 between the ears 22, see FIG. 4. The pivot member 21 can be removed from the presser arm 20, by withdrawing the shaft 26 from the bore in the presser arm 20.

The support member 13 is similarly pivotally supported at the end of its corresponding presser arm 27 but with a further degree of freedom. This freedom is provided by an intermediate pivot member 28 which carries the support member 13 journalled coaxially by a pin 16. The intermediate pivot member 28 is carried by pivot member 29 between ears 30 in trunnions 31. The pivot member 29 is removably supported on the presser arm 27 by means of a shaft 32 which is journalled in the presser arm 27. Rotation about the trunnions 31 is equally as restricted as rotation about the trunnions 23, by interaction of the back face 33 of the intermediate pivot member 28 and the root face 34 between the ears 30 of the pivot member 29. These elaborate pivots are provided in order to allow a single band 8 to be used with and conform to a large variety of mould sizes and shapes, with suitable adjustment to the supporting means. However, not only can one band unit accommodate a large number of shapes and sizes, but also two suitably handed, though otherwise identical band units, can be used for both the inside and outside of the same mould.

Figure 6:
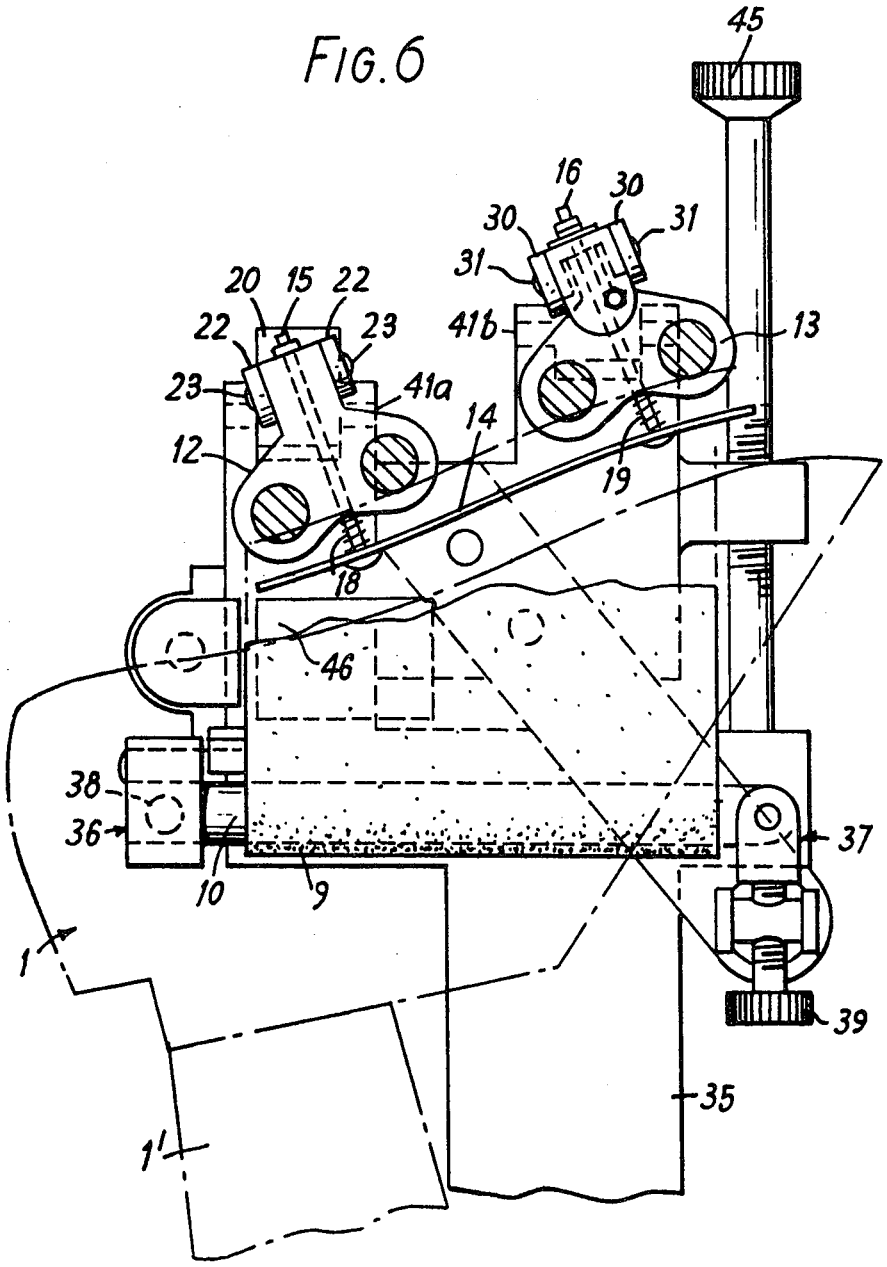
FIG. 6 is a part sectional side view on the line VI—VI in FIG. 5.

As mentioned above, the band assemblies 3 are carried on arms 35. The means, by which the pin 10 for supporting the band 8 at its fold 9, is mounted on the arm 35 is shown in FIGS. 5 and 6. The pin is supported in two brackets 36 and 37. Extending from each bracket 36, 37 is a shaft 38, each of which is accommodated in a bore in the arm 35. Springs 38*a* are provided to resiliently hold the pin 10, and the band 8, away from the arm 35.

The height of the toe end of the band on the pin 10 can be adjusted by means of a knob 39 which adjusts the height of the bracket 37. For reasons which will be explained later it is unnecessary to be able to adjust the height of the heel end of the band 8 on the pin 10. During a lasting operation the springs 38*a* are compressed as the band 8 is brought in towards a mould 1. However, the pin 10 is not acted upon directly to compress these springs, and a rubber covered strip 40, which is attached to brackets 36 and 37 comes into contact during operation with the mould via the band.

The presser arms 20 and 27 are pivoted to the top of the arm 35 at pivots 41*a*, 41*b*. The ends of the presser arms remote from the support members 12 and 13 have actuators 42 connected to them. These actuators are carried between lugs 43 on trunnions 44 provided on the arm 35. The actuators are actuated presser feet 7 are moved inward and downward towards the mould bottom. In order to be able to accommodate a large range of mould shapes and heel heights of finished shoe, the pivot 41*b* of the presser arm 27 can be adjusted independently of the position of the pivot 41*a* of the presser arm 20 by an adjuster 45 (FIG. 6).

Mounted on the arm 35 above and between the brackets 36 and 37 is a presser pad 46. The extension of this pad from the arm 35 can be adjusted by a spring loaded adjuster 47. The chief function of this presser pad is to act as a stop for the arm 35.

Figure 7:
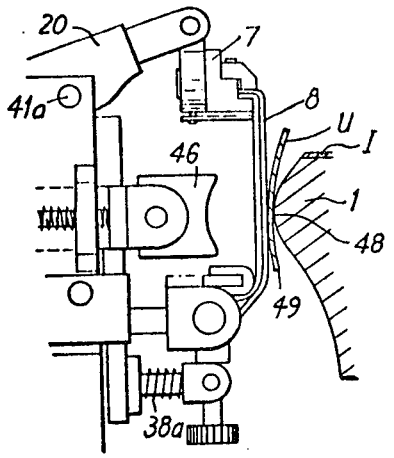
FIGS. 7, 8 and 9 are scrap end views similar to FIG. 5 and illustrating the sequence of movement of the band assembly in the waist lasting operation.
Figure 8:
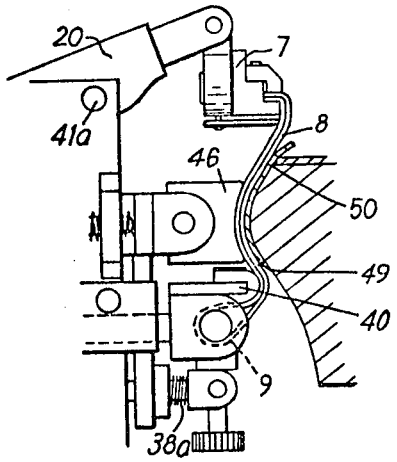

When an upper U and an insole I have been mounted on the mould as previously described, the band assemblies 3 and the actuators 42 are in their normal position as shown in FIG. 5. To waist last the upper U; the arms 35 are moved in and they advance the band assemblies towards the mould 1 via an intermediary position which is shown in FIG. 7. FIG. 7 shows the band just beginning to contact and conform the upper U to the mould at the point of furthest lateral extension 48 of the mould 1. As can be seen from the disposition of the top line 49 of the upper in this Figure in a conventional shoe this point 48 is appreciably below the top line 49 of the upper. As the band assembly is further advanced towards the mould the upper is smoothly conformed to the mould with the leading edges of contact moving upwards and downwards, thus producing a smoothly lasted finished upper. In the position shown in FIG. 8 the pad 46 on each arm has arrested the further advance of each arm 35, which is automatically held in this position until the waist lasting is complete. The extent of advance of arm 35 is controlled by the adjustment of the pad 46 by means of its adjuster 47 (FIG. 5) to enable the band to shape the upper into complete conformity with the mould from its top line 49 to its feather line 50 and to begin to turn the lasting margin of the upper on to the insole I. The side having now been released, the pad 46 assists in holding the upper in position against the mould. As can be seen in FIG. 8 the fold 9 in the band and the rubber covered strip 40 are well clear of the top line 49 of the upper, thus only the band and the pad 46 act upon the upper.

Figure 9:
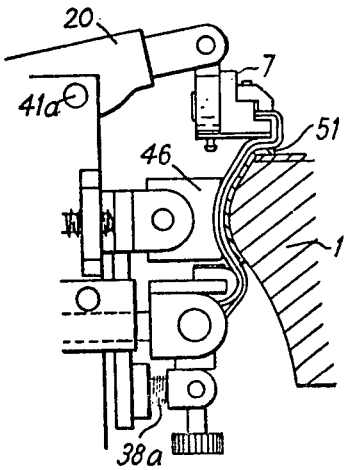

The final stage of waist lasting can be seen in FIG. 9, wherein the actuators 42 have been operated to press the feet and the band down onto the bottom of the mould. In so doing the lasting margin 51 of the upper is laid and pressed onto the insole I. It can thus be seen that the upper is entirely lasted in the waist region by contact of the band alone with the upper.

When a range of different shoe sizes is to be made on the same machine the same band units can be used, with different moulds. As can be seen in FIG. 2, the mould is arranged so that the position of the toe end of the bands corresponds to a point just behind the front of the back part mould 1. A band of given length can waist last a proportion of the length of a shoe which varies according to the size of the shoe; so that for example an heel seat laster which subsequently operates on the heel will have less work to do with a smaller shoe.

An advantageous addition to the waist lasting machine of this invention is to mount the mould on a pivotable post so that when the waist lasting operation is complete the mould and partly lasted shoe can be swung into a conventional seat laster 53 (see FIG. 1), the insole steady 52 having been released. To facilitate this mode of operation, it is further advantageous to standardize the planes in which the bottom of the heel part of the mould is operated on during both the waist and seat lasting operations. If this is done it is unnecessary to adjust the height of the heel end of the bands. However the adjusting knob 39 is provided to adjust the tension in the band and consequently the amount of work it does on the upper. The adjusting knob 45 is provided to enable shoes with different finished heel heights to be made. This is necessary because if the plane in which the bottom of the mould at the heel end is kept constant for moulds suitable for shoes of different heel heights the height of the front part of the bottom of the mould will vary.

Further reference to FIG. 1 will show the provision of a heater 54 in which an upper is hung by its back part over shaped and heated block 55 and when so placed is also exposed to radiant heating. An oven 56 is also provided for heating insoles. These means enable an upper and insole to be prepared while a waist and seat lasting operation is being carried out.

I claim:

1. Apparatus for lasting the waist region of a shoe comprising a post supporting a last, two lasting assemblies mounted for movement widthwise of the last and adapted for engaging respective sides of the waist region of an upper when arranged on the last, each assembly including a single resilient band extending under tension heightwise of the last and supported only at its upper and lower edges, means for moving each assembly towards the last so as to cause the band progressively to conform such upper to the last both in the direction of the top line and feather line of the shoe to be lasted and lengthwise of the last, means for preventing further movement of each assembly towards the last, and means for moving an edge of the band relative to the assembly both widthwise and heightwise of the last so that the part of the band adjacent the feather line is rolled over onto the last bottom whereby to turn over the lasting margin of such upper and press it onto an insole supported on the last.

2. Apparatus as claimed in claim 1 wherein each assembly includes a plurality of presser feet arranged in a row extending lengthwise of the last and means for moving the presser feet relative to the assembly both widthwise and heightwise of the last to press the resilient band against the last bottom.

3. Apparatus as claimed in claim 2 wherein each presser foot is so mounted in the assembly that it can take up the orientation of that part of the last bottom against which it is pressed.

4. Apparatus as claimed in claim 3 wherein the presser feet are pivotally mounted in pairs on respective support members which members in turn are pivotally mounted each on one end of respective pivoted levers.

5. Apparatus as claimed in claim 4 wherein each lever is pivotally mounted in the assembly at a point intermediate its ends and its other end is connected with an actuator carried on the assembly.

6. Apparatus as claimed in claim 2 wherein means is provided for pre-setting the position heightwise of the last of presser feet at one part of the row relative to that of presser feet in another part of the row.

7. Apparatus as claimed in claim 5 wherein means is provided for adjusting the position heightwise of the last of the pivotal mounting of one of the pivoted levers.

8. Apparatus as claimed in claim 2 wherein in order to distribute the pressure exerted by the presser feet the assembly includes a flexible plate arranged to extend beneath all the presser feet.

9. Apparatus as claimed in claim 2 wherein the resilient band is supported at one edge by clamping it to the upper side of the presser feet.

10. Apparatus as claimed in claim 2 wherein the resilient band is constituted by a strip of material folded upon itself, the free ends being clamped to the presser feet and the fold extending round a rod carried on the assembly.

11. Apparatus as claimed in claim 1 including means for adjusting the tension of the resilient band.

12. Apparatus as claimed in claim 1 including a toe gripper mounted on the last post and movable lengthwise of the last to hold an upper under tension around the back part of the last.

13. Apparatus as claimed in claim 12 including a pair of side grippers which operate to grip an upper and hold it at a predetermined position heightwise of the last.

14. Apparatus as claimed in claim 1 and including mechanism for carrying out a seat lasting operation wherein the last post is pivotally mounted whereby after a waist lasting operation has been performed the post may be moved to carry the last with a shoe thereon into position for carrying out a seat lasting operation.

15. Apparatus as claimed in claim 1 wherein the last is a back part mould.

16. Apparatus as claimed in claim 1 wherein the means for preventing further movement of an assembly towards the last comprise a stop mounted on the assembly and positioned to engage the last.

17. Apparatus as claimed in claim 16 wherein the stop is adjustably mounted.

18. Apparatus as claimed in claim 16 wherein the stop is positioned behind the resilient band.

* * * * *